US006231722B1

(12) United States Patent
Vestola

(10) Patent No.: US 6,231,722 B1
(45) Date of Patent: May 15, 2001

(54) METHOD AND SYSTEM FOR MONITORING THE PROCESS OF SEPARATION OF A WEB

(75) Inventor: Juhani Vestola, Jyväskylä (FI)

(73) Assignee: Valmet Corporation (FI)

( * ) Notice: Subject to any disclaimer, the term of this patent is extended or adjusted under 35 U.S.C. 154(b) by 0 days.

(21) Appl. No.: 09/297,962

(22) PCT Filed: Dec. 10, 1997

(86) PCT No.: PCT/FI97/00772

§ 371 Date: May 11, 1999

§ 102(e) Date: May 11, 1999

(87) PCT Pub. No.: WO98/27275

PCT Pub. Date: Jun. 25, 1998

(30) Foreign Application Priority Data

Dec. 16, 1996 (FI) ..... 965027

(51) Int. Cl.[7] ..... D21F 11/00

(52) U.S. Cl. ..... 162/198; 162/198; 162/DIG. 10; 162/DIG. 11; 162/252; 162/253; 162/255; 162/262; 162/263; 162/306

(58) Field of Search ..... 162/DIG. 10, DIG. 11, 162/198, 252, 253, 255, 262, 263, 306

(56) References Cited

U.S. PATENT DOCUMENTS 4,919,759 * 4/1990 Ilmarinen ..... 162/206
4,955,720 * 9/1990 Blecha ..... 356/429
5,026,458 * 6/1991 Beuther ..... 162/198

FOREIGN PATENT DOCUMENTS 89085 7/1988 (FI) ..... D21F/3/02

* cited by examiner

*Primary Examiner*—Stanley S. Silverman
*Assistant Examiner*—Mark Halpern
(74) *Attorney, Agent, or Firm*—Steinberg & Raskin, P.C.

(57) ABSTRACT

A method and system for monitoring a separation process of a web in a paper machine in which the web is separated from a roll and passed into a free draw, which is preferably the first free draw of the web in the paper machine. A separation point of the web from the roll and a difference in speed of the web across the separation point, i.e., the draw difference, are measured. Cause-to-effect ratios in the separation process are established, e.g., in a data collecting system or analysis system, based on the measurements of the separation point and the speed difference. At least one additional process or running parameter of the paper machine is measured and the measurements of the separation point and the speed difference are compared with the additional process or running parameter(s) to thereby determine the manner in which the separation process of the web is affected by the additional process or running parameter(s).

21 Claims, 2 Drawing Sheets

METHOD AND SYSTEM FOR MONITORING THE PROCESS OF SEPARATION OF A WEB

FIELD OF THE INVENTION

The invention relates to a method for monitoring the process of separation of a web, in which method the web is passed from a roll to a free draw of the web, in particular to the first free, unsupported draw of the web.

The invention also relates to a system for monitoring the process of separation of a web, which system is fitted in connection with the roll from which the web is passed to a free draw, in particular to the first free unsupported draw.

BACKGROUND OF THE INVENTION

In a press section of a paper machine, one of the most critical points with respect to runnability in the paper machine is the way the web behaves when it is separated from a centre roll. The separation of the web from the centre roll is especially important because the first free draw of the web is most often performed at this stage, that is to say the web is detached from the roll without support when it is especially susceptible to breaks if its properties and the factors affecting it have not been regulated correctly. The centre roll in the press has often constituted, as known per se, a critical point impairing runnability in the paper machine and it has limited the available maximum speed, even caused web breaks, and thereby reduced the efficiency of the paper machine.

Various factors affect the process of separation and the point of separation, i.e. the angle of separation, of the web. Among other things, properties of the web, linear loads of the press, draw differences in the press section, the wet end chemistry of the paper machine, the condition of the face of the centre roll, the operation of the doctor of the centre roll and the condition of jets used in connection with doctors, the selection of chemicals possibly used in connection therewith, all affect the separation point and, in addition, these factors are further partly dependent on one another. However, these factors influencing separation and indirectly also the operation of the doctor of the centre roll are not adequately known, because the effects of the factors influencing the process of separation may additionally appear with very different delays (from a second to weeks or months). Moreover, the effects may vary from one mill, process or moment to another. Since the process of separation has not been closely monitored, it has also not been possible to connect it with other process changes, and thus it has not been possible to establish right cause-to-effect ratios.

It is known from prior art to monitor the separation of the web by visually following an image of a video camera. However, this does not provide accurate information about the processes of separation but, instead, it gives random information because the monitoring of the separation process is based only on visual examination. Furthermore, the regulation measures possibly taken based on video camera monitoring have been mainly specific to a particular operator and based on the operator's personal analysis of the situation.

Thus, the monitoring of the separation of the web carried out by a video camera has not been accurate, and by means of it it has not been possible to monitor rapid changes in the separation process, nor has it been very simple to transfer the situations seen from it onto paper or into electric form to form proportional factors in a data collecting system of a paper machine, especially if normal sway of the separation process is large. Also, this arrangement provides the situation not farther away from the edge in the longitudinal direction of the roll but only at the edge of the web, which may cause miscalculations because the line of separation is not necessarily straight in the direction of the roll and, at the edge, there may occur disturbances that are not representative considering the whole web.

OBJECTS AND SUMMARY OF THE INVENTION

An object of the invention is to provide a method and an arrangement in which the behaviour of the web in separation may be closely monitored and, in addition, the factors influencing the process are monitored so as to establish the cause-to-effect ratios influencing the matter, which ratios may thus be efficiently observed and analysed, utilizing the obtained information in control.

An object of the invention is also to provide an arrangement which can be connected, when desired, to other information obtained from a paper machine.

With a view to achieving the objectives stated above and those that will come out later, the method according to the invention is mainly characterized in that, in the method, the point of separation of a web or a web point comparable thereto is measured when the web is passed from a roll to said free unsupported draw, and that, in the method, the draw difference, i.e. the speed difference, of the web across the separation point is measured, and that the results of measurement of the separation point and of the speed difference are transferred into a data collecting system and/or into an analysis system in order to establish the cause-to-effect ratios in the separation process.

The arrangement according to the invention, in turn, is mainly characterized in that the system comprises measurement members for measuring the point of separation of a web or a web point comparable thereto, measurement members for measuring the draw difference, i.e. the speed difference, of the web across the separation point, and a data collecting system and/or an analysis system, into which the results of measurement are transferred and in which, based on the measurement results, the factors affecting the separation process are established.

In accordance with the invention, several variables are simultaneously monitored and recorded, either all or, when desired, only certain ones at a time. The following factors may be monitored in the monitoring system in accordance with the invention:

1. draw difference of the web across the point of separation,
2. separation point of the web or a web point comparable thereto,
3. web tension after the separation point, for example, on a paper guide roll, preferably measured with a carbon fibre roll as a weighing roll or by means of a non-rotating tension measurement shoe,
4. variation in loading pressure; doctor vibration (for example, as variation in the pressure of a loading hose, which indicates, for instance, soiling of a roll),
5. moisture measurement immediately after a press section.

Since the variations in the separation of the web may result from a change in the properties of the web or in the face of a roll or in the liquid between them, it cannot be found out by monitoring only one of the above-mentioned variables 1–5 which of these three factors changes. Of course, most information is obtained by monitoring all the variables 1–5 simultaneously, but combinations of 1–4; 1–3; 1–2 and 4; 1–2 and 4–5 are also very useful. In order for the inventive idea to operate, the minimum requirement is to monitor the variables 1 and 2. The monitored factors are advantageously compared with other process and running parameters which are monitored in any case and/or intentionally on a paper machine, as known per se.

The draw difference is conventionally measured on all machines. The most important thing is to adjust the draw difference in terms of time to the same scale with measurement of the separation point.

In accordance with the invention, the point of separation of the web is monitored by means of an appropriate method, for instance, by means of a video+an image processing arrangement or by means of a linear camera and an image analysis associated therewith to establish the boundary between a dark and a light area, whereby it is seen where the separation point of the web is situated. The point of separation may also be measured by means of a laser measurement device, recording the separation point as invariable and regulating the draw difference. Other methods known per se for measuring the process are, of course, possible. Preferably, in connection with the invention, a distance measuring device based on the laser-Doppler method is used for measurement of the separation point to provide a quantity comparable to the separation point, i.e. the distance of the measuring device from the web in the tangential direction of the normal separation point, i.e. a relative separation location. If information about the absolute separation location is needed, the result may be calibrated, for example, based on laser measurement and on photographs taken simultaneously. The laser-Doppler measurement is particularly advantageous, because the measuring device may be placed outside the machine, the inside of the machine being, as a rule, rather cramped and unsuitable for meters.

Based on web tension measurement, it is possible to find out whether the properties of the web have changed such that the separation point changes. In that case, for example, a paper guide roll may be arranged to serve as a weighing roll, whereby changes in the forces directed from the web to the roll are measured, for example, as a change in weight in bearing housings, and this measurement result can be optimized with respect to the tension resultant of the web, thereby providing information about web tension. The profile of tension may also be measured by means of a shoe arrangement in which air pressure is blown against the web from a series of nozzles situated across the machine. If the tension of the web varies, the pressure value of blowing will also vary, and the tension profile of the web is found out based on the air pressure.

Besides variations in loading pressure, changes in the face of the roll, for instance, when the roll is soiled, are also found out by measuring the vibration of the doctor.

Moisture measurement after the press section provides information about changes which have occurred in linear pressure, in the moisture of the incoming web, in the condition of felts, etc. The changes are compared with changes in the separation process to establish ratios of effect.

The use of the arrangement in accordance with the invention provides systematic information as to which factor affects which property in the separation process and, then, this information can be combined with other variables of the paper machine. At the same time, the state of operation of the doctor can be established.

Naturally, the measurement arrangement in accordance with the invention can be accomplished in connection with a roll even other than the centre roll of the press, but the most important feature is that said roll is followed by a free draw of the web, in particular the first free draw of the web.

BRIEF DESCRIPTION OF THE DRAWINGS

In the following, the invention will be described in more detail with reference to the figures of the accompanying drawing, to the details of which the invention is, however, by no means intended to be strictly confined.

DETAILED DESCRIPTION OF THE PREFERRED EMBODIMENTS

Figure 1:
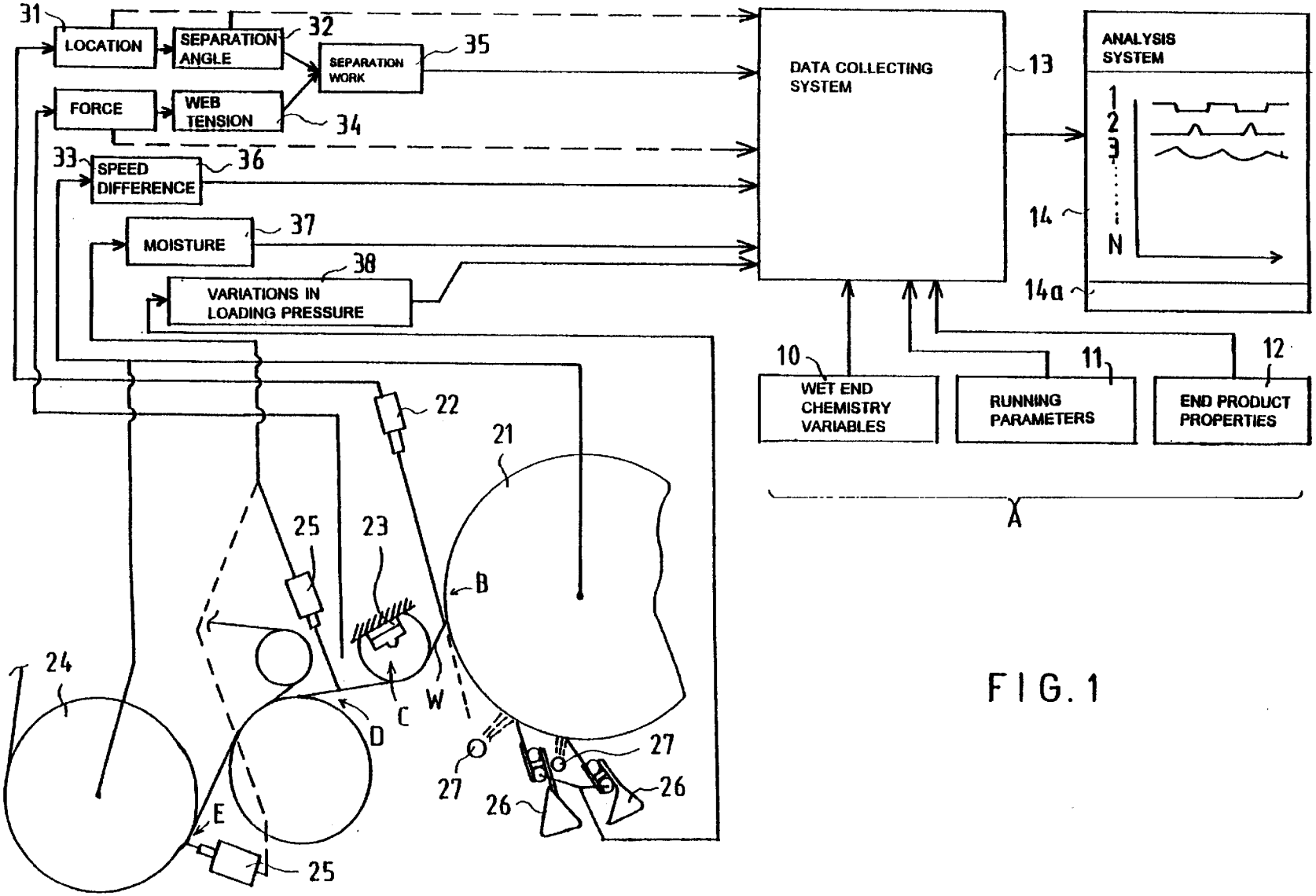
FIG. 1 is a schematic block diagram of the arrangement in accordance with the invention connected to a system per se known for collecting data of other properties in a paper machine.

As shown in FIG. 1, prior art arrangements (part A) measure, for example, variables of the wet end chemistry in a block 10, running parameters in a block 11 and end product properties in a block 12. These data are fed to a data collecting system 13 in electric form, after which the data are passed to an analysis system 14, where the changes in variables are established as a function of time and/or correlation analyses 14*a* are made.

The measurement of the variables of the wet end chemistry in the block 10 includes, among other things, measurement of pH, temperature, conductivity, retention, the state of charge, COD, i.e. chemical oxygen demand, beating degree, flow rates, feed quantities, consistencies, surface heights, aluminium, calcium and silicate ion contents, etc. Of the running parameters shown in the block 11, among other things, speed, jet/wire ratio, linear loads, vacuums, steam quantities, dewatering measurement, etc. are measured. The block 12, end product properties, includes, among other things, breaks, holes/spots, grammage, moisture, ash, formation, porosity, optical properties, etc.

As shown in FIG. 1, the location of the separation point is measured at a point B on a centre roll 21 by means of a laser-Doppler measuring device 22 to a block 31, which is converted into a separation angle to a block 32. Either the separation location 31 or the separation angle 32 can be passed directly to the data collecting system 13. Changes in force 33 from bearing housings 23 are measured at a point C and, based on it, information about web tension is obtained for a block 34. Either the force 33 or the web tension 34 can be passed directly to the data collecting system 13. Separation work 35 is most advantageously determined on the basis of the separation angle 32 and the web tension 34, which information is passed to the data collecting system 13.

A speed difference 36 is determined, for example, between the centre roll 21 and a roll 24. The moisture values of the web are measured at a point D after the centre roll 21 or at a point E by means of a moisture meter 25 in connection with the roll 24 or at some other point as soon as possible after the point of separation. The operation of doctors 26 and their possible vibration are monitored in order to measure variations of loading pressure 38. If desired, it is also possible to monitor the operation of jets 27 and the effect of the chemicals used in them. In this way, the five essential quantities influencing the process of separation are established, and the essential cause-to-effect ratios influencing the process of separation are established on the basis thereof or by additionally monitoring other information obtained from the paper machine.

The proportion of the face of the roll 21 in separation is best depicted by separation work W.

$$W=(T-m\upsilon^2)(1-\cos\phi),$$

where

T=web tension m=basis weight of the web at the moment of separation $\upsilon$=web speed, and $\phi$=separation angle When web tension is measured by means of a weighing roll or a shoe, the proportion caused by the centrifugal force in the web tension ($m\ \upsilon^2$) will not be included in the measurement. The thus measured tension is directly ($T-m\ \upsilon^2$), which multiplied by the term ($1-\cos\phi$) gives the separation work. Since the wrapping angle about the weighing roll changes with changing separation angle, the force directed to the roll is not directly proportional to the tension ($T-m\ \upsilon^2$). However, if the directions of measurement of measuring detectors are suitably selected, it leads to a situation that, at the separation angles found in practice, the signal of the detectors is sufficiently accurately directly proportional to the above-mentioned tension, which simplifies the processing of results and the computing of the separation work. If it is not desired to compute the value of the separation work, the above-mentioned separation point signal represents sufficiently well the changes which occur at the separation point. These methods enable continuous monitoring of the separation point in electric form, which cannot be done, for example, by means of a conventional video camera without image processing.

Figure 2A:
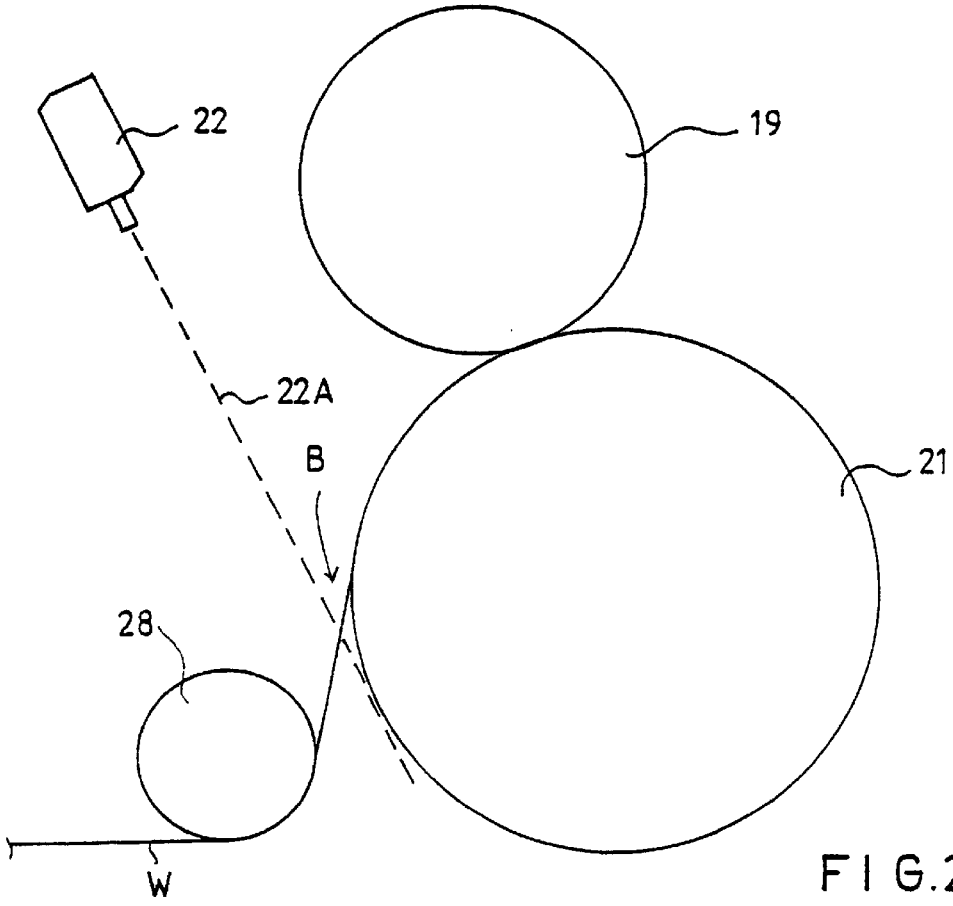
FIGS. 2A and 2B schematically show measurement of a separation point by means of the laser-Doppler method.
Figure 2B:
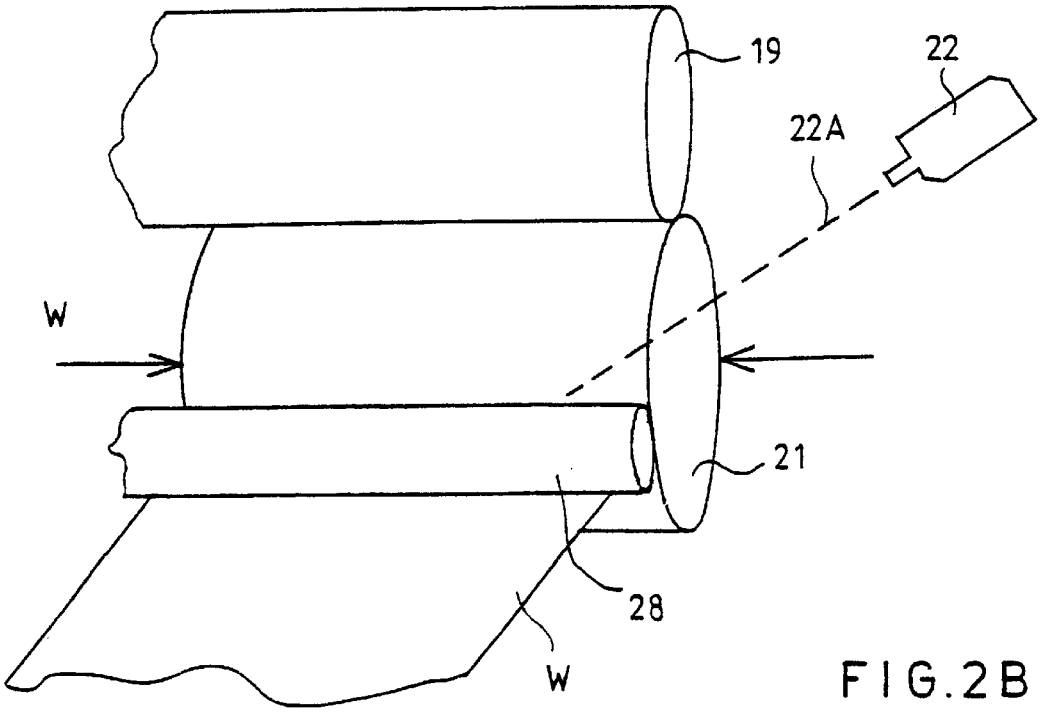

As shown in FIG. 2A, the centre roll is denoted with the reference numeral 21, and the point of separation of the paper web W from the centre roll 21 is measured by means of a laser-Doppler measurement 22. The web W runs through a nip defined by center roll 21 and roll 19 before the open draw and after the open draw, around a paper guide roll 28, which may be a weighing roll. The same is shown in the cross-sectional view of FIG. 2B. As seen from the figures, measurement may be performed by the laser-Doppler method obliquely towards the separation point B of the web W, thereby obtaining information from the middle area of the roll 21 in the longitudinal direction outside the disturbance area of the edge of the web. When the separation point B is measured by the laser-Doppler device 22, which measures the distance to an intersection of the web W and a beam 22A, or by a linear camera, which uses illumination of the web for providing contrast at the separation point and in which the location of the dark/light boundary is measured, the actual separation angle must be determined first simultaneously by other methods, for example, by measuring from a photograph. The separation point signal is converted into a separation angle by means of the thus obtained calibration curve. It is, of course, also possible to monitor the relative value of the separation point.

Above, the invention has been described with reference to some of its preferred exemplifying embodiments only, to the details of which the invention is, however, by no means intended to be narrowly confined. Many variations and modifications are possible within the scope of the inventive idea defined in the following claims.

What is claimed is:

1. A method for monitoring a separation process of a web in a paper machine in which the web is separated from a roll and passed into a free draw, comprising the steps of:

measuring a separation point of the web from the roll, measuring a difference in speed of the web across the separation point, wherein said difference in speed is the difference between a rotational speed of a center roll from which the web is separated and passed into said free draw and a rotational speed of a roll disposed after the separation point, establishing cause-to-effect ratios in the separation process based on the measurements of the separation point and the speed difference and transferring the measurements into a data collecting system, measuring at least one additional process or running parameter of the paper machine, and comparing the measurements of the separation point and the speed difference with the at least one additional measured process or running parameter to thereby determine the manner in which the separation process of the web is affected by the at least one additional process or running parameter.

2. The method of claim 1, wherein the step of establishing the cause-to-effect ratios comprises the step of transferring the measurements into an analysis system.

3. The method of claim 1, wherein the free draw of the web is a first free draw of the web in the paper machine.

4. The method of claim 1, further comprising the step of:

measuring the tension of the web after the separation point, the cause-to-effect ratios in the separation process being established based on the measurements of the separation point, the speed difference and the measured web tension.

5. The method of claim 4, wherein the step of measuring the tension of the web comprises the step of:

passing the web over a weighing roll.

6. The method of claim 4, wherein the step of measuring the tension of the web comprises the step of:

utilizing a non-rotating tension measurement shoe.

7. The method of claim 4, further comprising the step of:

determining separation work based on the measured separation point and the measured tension of the web.

8. The method of claim 1, further comprising the step of:

measuring a variation in loading pressure of a doctor blade operative against the roll, the cause-to-effect ratios in the separation process being established based on the measurements of the separation point, the speed difference and the measured variation in loading pressure of the doctor blade.

9. The method of claim 1, further comprising the step of:

measuring moisture of the web after the separation point, the cause-to-effect ratios in the separation process being established based on the measurements of the separation point, the speed difference and the measured web moisture.

10. The method of claim 1, wherein the step of establishing the cause-to-effect ratios of the separation process comprises the step of adjusting the measurement of the speed difference in terms of time to the same scale as the measurement of the separation point.

11. The method of claim 1, further comprising the steps of:

measuring the tension of the web after the separation point, measuring a variation in loading pressure of a doctor blade operative against the roll, measuring moisture of the web after the separation point, the cause-to-effect ratios in the separation process being established based on the measurements of the separation point, the speed difference, the measured web tension, the measured variation in loading pressure of the doctor blade and the measured web moisture, and the step of establishing the cause-to-effect ratios of the separation process comprising the steps of:

adjusting the measurement of the speed difference in terms of time to the same scale with the measurement of the separation point, and adjusting at least one of the measured web tension, the measured variation in loading pressure of the doctor blade and the measured web in terms of time to the same scale as the measurement of the separation point.

12. The method of claim 1, further comprising the steps of:

measuring the tension of the web after the separation point, measuring a variation in loading pressure of a doctor blade operative against the roll, measuring moisture of the web after the separation point, the cause-to-effect ratios in the separation process being established based on the measurements of the separation point, the speed difference, the measured web tension, the measured variation in loading pressure of the doctor blade and the measured web moisture, and comparing the measured web tension, the measured variation in loading pressure of the doctor blade and the measured web moisture with the at least one additional process or running parameter to thereby determine the manner in which the web tension, loading pressure of the doctor blade and web moisture are affected by the at least one additional process or running parameter.

13. The method of claim 1, wherein the step of measuring the separation point of the web comprises the step of:

utilizing a laser-Doppler measuring device.

14. The method of claim 1, wherein the step of measuring the separation point comprises the step of:

utilizing a linear camera.

15. The method of claim 1, further comprising the step of:

measuring the tension of the web after the separation point, measuring a variation in loading pressure of a doctor blade operative against the roll, measuring moisture of the web after the separation point, the cause-to-effect ratios in the separation process being established based on the measurements of the separation point, the speed difference, the measured web tension, the measured variation in loading pressure of the doctor blade and the measured web moisture, and comparing the measurements of the separation point, the speed difference, the measured web tension, the measured variation in loading pressure of the doctor blade and the measured web moisture with measurement results of at least one of a chemistry variable of a wet end of the paper machine and measurement results relating to a property of the web in its final form.

16. A system for monitoring a separation process of a web in a paper machine in which the web is separated from a roll and passed into a free draw, comprising:

first measuring means for measuring a separation point of the web from the roll, second measuring means for measuring a difference in speed of the web across the separation point, wherein said difference in speed is the difference in speed between a center roll from which the web is separated into the free draw and a roll disposed after the separation point, third measuring means for measuring at least one of a chemistry variable of a wet end of the paper machine, a running parameter of the paper machine and a property of the web in its final form, means for receiving the measurements from said first, second and third measuring means and determining the manner in which the separation process of the web is affected by the measurement from said third measuring means, and fourth measuring mans for measuring a property of the web selected from the group consisting of the moisture of the web and the tension of the web, said receiving means being arranged to receive the measurements from said fourth measuring means and determine the manner in which the separation process of the web is affected by the measurement from said fourth measuring means.

17. The system of claim 16, wherein said fourth measuring means measure the tension of the web and comprise a weighing roll arranged such that the web passes thereover.

18. The system of claim 16, wherein said fourth measuring means measure the tension of the web and comprise a non-rotating tension measurement shoe.

19. The system of claim 16, wherein said first measuring means comprise a laser-Doppler measurement device.

20. The system of claim 16, wherein said first measuring means comprise a linear camera.

21. A method for monitoring a separation process of a web in a paper machine in which the web is separated from a roll and passed into a free draw, comprising the steps of:

measuring a separation point of the web from the roll, measuring a difference in speed of the web across the separation point, wherein said difference in speed is the difference between a rotational speed of a center roll from which the web is separated and passed into said free draw and a rotational speed of a roll disposed after the separation point, establishing cause-to-effect ratios in the separation process based on the measurements of the separation point and the speed difference and transferring the measurements into an analysis system, measuring at least one additional process or running parameter of the paper machine, and comparing the measurements of the separation point and the speed difference with the at least one additional measured process or running parameter to thereby determine the manner in which the separation process of the web is affected by the at least one additional process or running parameter.

* * * * *